United States Patent [19]

Nadkarni et al.

[11] Patent Number: 4,752,334

[45] **Date of Patent: * Jun. 21, 1988**

[54] DISPERSION STRENGTHENED METAL COMPOSITES

[75] Inventors: Anil V. Nadkarni, Mentor; Prasanna K. Samal, Lyndhurst, both of Ohio; James E. Synk, Philadelphia, Pa.

[73] Assignee: SCM Metal Products Inc., Cleveland, Ohio

[ * ] Notice: The portion of the term of this patent subsequent to Apr. 3, 2001 has been disclaimed.

[21] Appl. No.: 561,035

[22] Filed: Dec. 13, 1983

[51] Int. Cl.[4] ..... C22C 29/12

[52] U.S. Cl. ..... 75/235; 75/232; 75/951; 428/558

[58] Field of Search ..... 75/232, 234, 235, 0.5 BC, 75/951; 419/19, 41, 4; 428/558; 200/144 B

[56] References Cited

U.S. PATENT DOCUMENTS

| | | | |
|---|---|---|---|
| 3,779,714 | 12/1973 | Nadkarni et al. | 419/19 |
| 3,893,844 | 7/1975 | Nadkarni | 419/19 |
| 4,075,010 | 2/1978 | Fischer | 75/235 |
| 4,077,816 | 3/1978 | Nadkarni | 419/19 |
| 4,139,378 | 2/1979 | Bankowski et al. | 75/247 |
| 4,158,719 | 6/1979 | Frantz | 419/19 |
| 4,198,234 | 4/1980 | Cadle et al. | 419/10 |
| 4,274,873 | 6/1981 | Nadkarni | 419/19 |
| 4,315,777 | 2/1982 | Nadkarni et al. | 75/232 |
| 4,389,250 | 6/1983 | Melton et al. | 75/235 |
| 4,440,572 | 4/1984 | Nadkarni et al. | 75/235 |
| 4,478,787 | 10/1984 | Nadkarni et al. | 75/235 |
| 4,501,941 | 2/1985 | Cherry | 200/144 B |

*Primary Examiner*—John F. Terapane
*Assistant Examiner*—Eric Jorgensen
*Attorney, Agent, or Firm*—Lieberman, Rudolph & Nowak

[57] ABSTRACT

There is provided a substantially fully dense powdered metal composite comprising a highly conductive metal or metal alloy matrix having dispersed therein discrete microparticles of a refractory metal oxide and discrete macroparticles of an additive metal or metal alloy, such as a nickel/iron alloy. The respective components undergo minimal alloying because sintering is not utilized in forming the composite. These composites are characterized by high thermal or electrical conductivity and a desired property attributable to the composite forming additive metal or metal alloy. The composites are useful in forming lead frames for integrated circuit chips, electric lamp lead wires, and electrical contact members.

19 Claims, 7 Drawing Sheets

DISPERSION STRENGTHENED METAL COMPOSITES

This invention is in the powder metallurgy field and relates to metal composites in which one of the metallic ingredients is a preformed dispersion strengthened metal, e.g., dispersion strengthened copper, and a second is a different metal or metal alloy capable of conferring a desired characterizing mechanical or physical property on the composite, for example, a low coefficient of expansion, whereby high electrical conductivity together with certain mechanical and physical properties can be easily achieved. The composites of the invention are consolidates produced by pressing, extrusion, swaging or rolling in combinations thereof and take the shape of billets, strips, rods, tubes or wires. These composites can be fabricated to have a wide range of mechanical, thermal, magnetic, hardness, etc., properties as well as electrical properties, which are not common to conventional composite systems.

BACKGROUND OF THE INVENTION AND PRIOR ART

This invention has for its principal objective the provision of a material that has relatively good electrical and thermal conductivity, and, for example, a low coefficient of thermal expansion or a high hardness, or high wear resistance, magnetic properties, etc. Achievement of these objectives is accomplished by blending powders of (a) a preformed dispersion strengthened metal, e.g., dispersion strengthend copper, silver, or aluminum desirably having an electrical resistivity below $8\times10^{-6}$ ohm-cm and (b) a different hard metal or hard metal alloy, e.g., one having a low coefficient of expansion, i.e., below $10\times10^{6}$/°C. at 20° C. or a metal alloy, e.g., iron-nickel alloys containing from 30% to 55% nickel by weight and minor additives such as manganese, silicon and carbon, etc., and compacting without a sintering step to substantially full density. By "preformed" as used herein is meant that the dispersion strengthened metal is provided as a dispersion strengthened metal powder before blending with component (b).

Dispersion strengthened metals are well known. Reference may be had to Nadkarni et al U.S. Pat. No. 3,779,714 and the references discussed in the text thereof for examples of dispersion strengthened metals, especially copper, and methods of making dispersion strengthened metals. The disclosure of U.S. Pat. No. 3,799,714 is incorporated herein by reference. In this patent, dispersion strengthened copper (hereinafter called "DSC") is produced by forming an alloy of copper as a matrix metal and aluminum as a refractory oxide forming solute metal. The alloy containing from 0.01% to 5% by weight of the solute metal, is comminuted by atomization, (See U.S. Pat. No. 4,170,466) or by conventional size reduction methods to a particle size, desirably less than about 300 microns, preferably from 5 to 100 microns, then mixed with an oxidant. The resultant alloy powder-oxidant mixture is then compacted prior to heat treatment, or heated to a temperature sufficient to decompose the oxidant to yield oxygen to internally oxidize the solute metal to the refractory metal oxide in situ and thereby provide a very fine and uniform dispersion of refractory oxide, e.g., alumina, throughout the matrix metal. Thereafter the preformed dispersion strengthened metal is collected as a powder or submitted to size reduction to yield a powder having a particle size of from −20 mesh to submicron size for use herein. Mechanical alloying of the matrix and solute metals as by prolonged ball milling of a powder mixture of 40 to 100 hours can also be used prior to internal oxidation.

Dispersion strengthening can be accomplished in a sealed can or container (U.S. Pat. No. 3,884,676). The alloy powder may be recrystallized prior to dispersion strengthening (U.S. Pat. Nos. 3,893,844 and 4,077,816). Other processes are disclosed in U.S. Pat. Nos. 4,274,873; 4,315,770 and 4,315,777. The disclosures of all of the foregoing U.S. Patents are incorporated herein by reference thereto. These patents are commonly owned with the present application.

Composites of metal powders having low thermal expansion characteristics and low resistivity are known.

Reference may be had to U.S. Pat. No. 4,158,719 to Frantz. According to this patent, a composite is made by compacting a mixture of two powders, one of which has low thermal expansivity and the other of which has high thermal conductivity. The composite is useful, as are the products of the present invention, in the production of lead frames for integrated circuit chips. Frantz's composite is made by mixing the powders, forming into a green compact, sintering and then rolling to size. The low thermal expansivity alloy is 45 to 70% iron, 20–55% nickel, up to 25% cobalt and up to 5% chromium. The high thermal conductivity metal is iron, copper, or nickel. None of the metals is dispersion strengthened. The nickel/iron alloy containing 36% Ni, balance Fe with Mn, Si and C totalling less than 1% is known as "Nilvar" or "Alloy 36". The nickel/iron alloy containing 42% nickel, balance Fe with Mn, Si and C totalling less than 1% is a member of a family of nickel/iron alloys known as Invar. It is also known as Alloy 42. The nickel/iron alloy containing 46% Nickel, balance Fe with Mn, Si and C totalling less than 1% is known as Alloy 46. Similarly Alloys 50 and 52 comprise 50% Ni and 52% Ni, respectively, balance Fe.

The respective properties of the sintered composites of the prior art and the unsintered composites of the present invention have been studied.

A composite strip and wire made with DSC and copper and each of (1) 36% Ni/64% Fe and (2) 42% Ni/58% Fe Invar type alloys, respectively. The powders were blended 50:50 and the respective procedures followed for forming the composites. Those composites made with DSC and the Invar alloys have high strength and good strength retention after exposure to high temperatures. The prior art material iron with alloy (1) and iron with alloy (2) shows higher strength than copper metal with alloys (1) or (2), but this is only with the sacrifice of electrical conductivity.

To obtain high strength with copper composites, the prior art has to use fine powder which reduces conductivity significantly. Coarse copper powder yields high conductivity but lower strength.

Another example of the prior art is the patent to Bergmann et al U.S. Pat. No. 4,366,065. This patent discloses the preparation of a composite material by powder metallurgy wherein a starting material comprised of at least one body-centered cubic metal contaminated by oxygen in its bulk and on its surface is mixed with a less noble supplemental component having a greater binding enthalpy for oxygen in powder form or as an alloy whereby the oxygen contaminant becomes bound to the supplemental component (aluminum) by internal solid state reduction. The composite is then deformed in at least one dimension to form ribbons or fibers thereof. Niobium-copper is exemplified with aluminum as the oxygen getter.

A principal advantage of using DSC as opposed to using plain copper appears to be that DSC enables closer matching of stresses required for deformation of the two major components. Because of this closer matching, the powder blends and composites can be co-extruded, hot forged, cold or hot rolled and cold or hot swaged. When one of the components undergoing such working is excessively harder, for example, than the other, then the particles of the harder component remain undeformed. The flow of softer material over and around the harder particles generally leads to the formation of voids and cracks, and hence weakness in the structure. The greater strength of the DSC material over the unmodified or plain copper enables closer matching with the hard metal as, for example, with respect to yield strength, and the size and shape of the regions occupied by the individual components will be more nearly alike. Closer matching of forming stresses enables achievement of full density for the powder blend in one hot forming operation, such as extrusion, or multiple size reduction steps such as swaging or rolling. This eliminates the need for sintering. The prior art utilizes two sintering steps at very high temperatures (1850° F. for copper and 2300° F. for iron). These temperatures promote inter-diffusion of atoms of the two components, or alloying, to occur. Diffusion of iron and/or nickel or other metals into copper lowers the electrical conductivity of the copper and conversely, diffusion of copper into the hard metal adversely effects its coefficient of thermal expansion.

In carrying out the present invention the temperatures encountered are below sintering temperature used in prior art procedures and inter-diffusion of atoms, or alloying, between the principal components is reduced. From the prior art it is evident that when sintering time is increased from 3 minutes to 60 minutes, the electrical resistivity does increase significantly from 35 up to 98 microhm-cm. (See examples 4 and 6 and examples 5 and 7 U.S. Pat. No. 4,158,719). Stated in another way, electrical conductivity decreases significantly. This variation in resistivity or conductivity indicates that inter-diffusion of copper and nickel (for example, from Invar alloy 42) is a serious problem. Use of DSC instead of copper or a copper alloy retards such inter-diffusion because the dispersed refractory oxide, e.g., $Al_2O_3$ acts as a barrier to or inhibitor of diffusion. DSC (AL 15) has an electrical conductivity of 90–92% IACS and an annealed yield strength of 50,000 psi.

Other patent references of interest include Mackiw et al U.S. Pat. No. 2,853,401 which discloses chemically precipitating a metal onto the surface of fine particles of a carbide, boride, nitride or silicide of a refractory hard metal to form a composite powder and then compacting the powder. Hassler U.S. Pat. No. 4,032,301 dicloses a contact material for vacuum switches formed of mixed powders of a high electrical conductivity metal, e.g., copper, and a high melting point metal, e.g., chromium, compacted, and sintered. Bantowski, 4,139,378 is concerned with brass powder compacts improved by including a minor amount of cobalt. The compacts are sintered. Cadle et al U.S. Pat. No. 4,198,234 discloses mixing a pre-alloy powder of chromium, iron, silicon, boron, carbon and nickel at least about 60%, and copper powder, compacting the blend and sintering at 1050° C. to 1100° C. to partly dissolve the copper and nickel alloy in one another.

The present invention is distinguished from the prior art particularly in that it utilizes a preformed dispersion strengthened metal, e.g., DSC, dispersion strengthened aluminum or dispersion strengthened silver. The product of this invention in addition to having relatively high electrical conductivity, has improved mechanical properties not possessed by the prior art composites. The material is compacted to substantially full density without a sintering step.

BRIEF STATEMENT OF THE INVENTION

Briefly stated, the present invention is in a substantially fully dense composite comprising a metal matrix having dispersed therein discrete microparticles of a refractory metal oxide, and discrete macroparticles of a different metal or metal alloy, desirably a hard metal or hard metal alloy having a coefficient of expansion below $10\times10^{-6}$/°C. at 20° C. More specifically, the present invention is in a dense composite of dispersion strengthened copper having dispersed therein discrete particles of a hard metal or hard metal alloy, e.g., Invar or Nilvar, Kovar, molybdenum. While some alloying occurs with nickel alloys, essentially no alloying occurs with tungsten and molybdenum and the degree of alloying is less than these elements or alloys exhibit with plain copper. The products hereof are characterized by good electrical and thermal conductivity and another mechanical or physical property characteristic of the different metal or metal alloy, for example, a low coefficient of thermal expansion. Those products having low coefficient of thermal expansion are especially useful in fabricating lead frames for semiconductors and integrated circuits, as well as inlead wires in electric lamps. Other composites include these characterized by high strength, high wear resistance or magnetic properties. The invention also contemplates a method for producing such composites charcterized by densifying a blend of (a) a dispersion strengthened hard metal powder and (b) a powdered hard metal or hard metal alloy at a temperature low enough to minimize alloying between (a) and (b).

BRIEF DESCRIPTION OF THE DRAWINGS

The annexed drawings are photographs or photomicrographs for better understanding and illustrating the invention or comparing invention results with prior art results and wherein.

F. and 1600° F., respectively, according to Example XI below.

Figure 7:
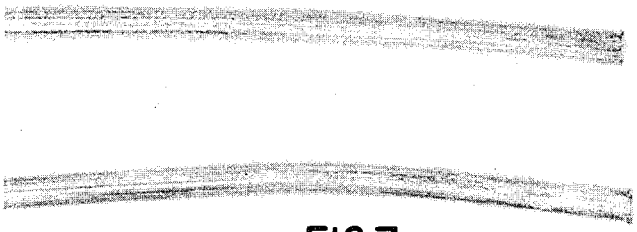
FIG. 7 is a photograph showing dispersion strengthened copper/Alloy 42 composite rods extruded at 1450°
Figure 8:
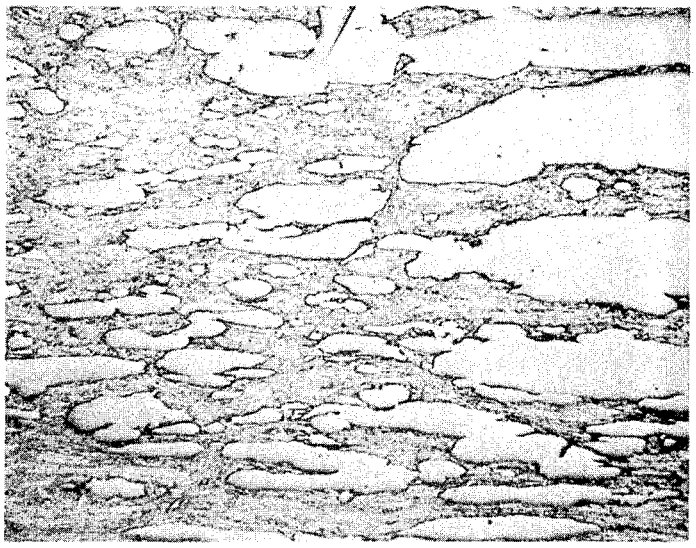

FIG. 8 is a photomicrograph of a longitudinal section of the rod in FIG. 7 extruded at 1450° F. according to Example XI below.

Figure 9:
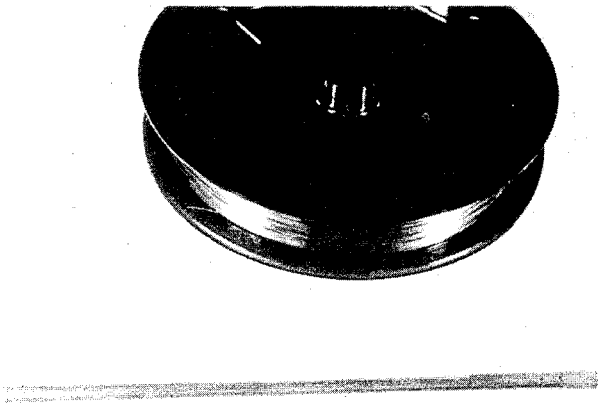

FIG. 9 is a photograph showing the rod of FIG. 8 after 2 drawing passes and showing the finished wire.

Figure 10:
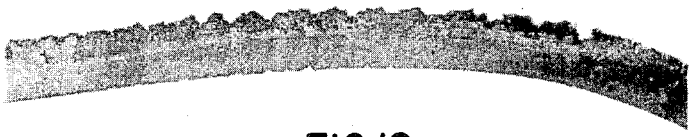

FIG. 10 is a photograph of an electrolytic copper/Alloy 42 composite after extruding to a rectangular rod, and attempting to cold roll according to Example IV below.

Figure 11:
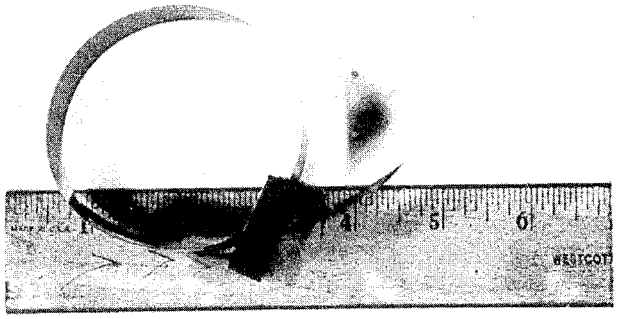

FIG. 11 is a photograph of a dispersion strengthened copper/Alloy 42 composite after extruding to a rectangular rod and cold rolling according to Example V below.

Figure 12:
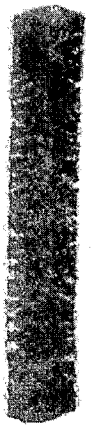

FIG. 12 is a photograph of an electrolytic copper/Alloy 42 composite treated according to Example XIV below.

Figure 13:
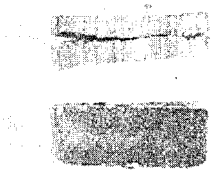

FIG. 13 is a photograph of a dispersion strengthened copper/Alloy 42 composite treated according to Example XV below.

DETAILED DESCRIPTION OF THE INVENTION

As indicated above, there are two principal constituents of the composite metal systems hereof. These are (a) a high conductivity dispersion strengthened metal having discrete microparticles, i.e., smaller than 0.1 micron, of a refractory metal oxide uniformly dispersed throughout the body of a matrix metal and desirably formed by an internal oxidation process, such as described in U.S. Pat. No. 3,799,714 above; and (b) discrete macroparticles, i.e., larger than 1 micron of a different metal or metal alloy. For convenience, the invention will be discussed in detail with reference to (a) dispersion strengthened copper containing uniformly dispersed therein microparticles of aluminum oxide and prepared by internal oxidation of the aluminum from an alloy of aluminum and copper; and (b) a low coefficient of expansion nickel/iron alloy, e.g., Invar. It will be understood, however, that the principles of the invention are applicable in the same manner to other dispersion strengthened metals, for example, dispersion strengthened silver, aluminum, etc., copper alloys such as brass, bronze, etc., and to other metals, metal alloys or intermetallic compounds (e.g., samarium/cobalt) having a low coefficient of expansion. The term "alloy" as used herein will be understood as including intermetallic compounds.

"GlidCop" (a registered trademark of SCM Corporation) DSC is made in powder form in several different grades and consist of a copper matrix having a dispersion of submicroscopic particles of $Al_2O_3$; with the amount of $Al_2O_3$ being 0.3%, (AL 15) 0.4%, (AL 20) 0.7%, (AL 35) and 1.1% (AL 60) by weight. The equivalent aluminum content is from 0.15 to 0.6%. These materials have Copper Development Association (CDA) numbers C15715, C15720, C15735 and C15960, respectively. The refractory metal oxide is very uniformly dispersed by virtue of internal oxidation of a solute metal, e.g., aluminum, alloyed in the copper metal prior to mixing with an oxidant powder and internally oxidizing. The aluminum oxide particles resulting from internal oxidation are discrete and have a size less than 0.1 micron and generally of the order of about 100 Angstroms; hence, "microparticles". Invar type alloys are a family of alloys of iron and nickel, with nickel content ranging from 30% to 55%, by weight and with minor additives or impurities such as manganese, silicon and carbon, not exceeding 1% by weight, the balance being iron. Kovar alloys are like the Invar alloys in which part or all of the nickel is replaced with cobalt, a typical example being 28% Ni, 18% Co, bal. Fe. Other hard metals, such as molybdenum, titanium, niobium, etc., or hard metal alloys or compounds, formed from cobalt and iron, nickel and chromium, nickel and molybdenum, chromium and molybdenum may be used as well in carrying out the present invention. The hard metals or hard metal alloys desirably have a particle size in the range of about 5 to 300 microns; hence, "macroparticles". D. S. Coppers possess high tensile strength, yield strength and moderate ductility, along with high electrical conductivity and thermal conductivity. D. S. Coppers retain their strength very well after exposure to high temperatures (such as in the range of 1400° F. to 1800° F.)—a property not found in any other high conductivity copper alloys. Table 1 below lists properties of commercial DSC. It may be noted here that DSC can be produced only by powder metallurgy technology.

In general, the relative proportions of (a) and (b) will be dictated by the ultimate desired properties of the composite. Broadly we use components (a) and (b) in a volume ratio of 5:95 to 95:5 and most usefully in a volume ratio of from 25:75 to 75:25. Corresponding weight ratios may be used as well.

TABLE 1

COMPARATIVE PROPERTIES OF GLIDCOP AND ALLOY 42

| PROPERTY | UNIT | GLIDCOP AL 20 | GLIDCOP AL 60 | ALLOY 42 |
|---|---|---|---|---|
| Chemical Composition | Weight % | Cu + .4% $Al_2O_3$ | Cu + 1.1% $Al_2O_3$ | 42% Ni, 0.34% Mn 0.01% C., Bal. Fe |
| Density | gm/cc | 8.81 | 8.78 | 8.00 |
| Electrical Resistivity | at 20° C., Microhm-Cm | 1.94 | 2.21 | 80.00 |
| Electrical Conductivity | at 68° F., % IACS | 89 | 78 | 2 |
| Thermal Conductivity | at 20° C., cal/cm$^2$/cm/sec/°C. | 0.84 | 0.77 | 0.026 |
| Coefficient Of Thermal Expansion | $10^{-6}$/°C. cm/°C. | 19.6 | 20.4 | 5.2 |
| Tensile Strength | 1000 psi | 68–82 | 83–90 | 65–90 |
| Yeild Strength | 1000 psi | 53–74 | 75–84 | 40–60 |

TABLE 1-continued

| PROPERTY | UNIT | COMPARATIVE PROPERTIES OF GLIDCOP AND ALLOY 42 | | |
|---|---|---|---|---|
| | | GLIDCOP AL 20 | GLIDCOP AL 60 | ALLOY 42 |
| Elongation | % | 10–21 | 10–14 | 6–40 |

Invar type alloys, which are nickel/iron alloys, have low electrical and thermal conductivity, good room temperature mechanical strength and a uniquely low coefficient of thermal expansion. Properties of the most commonly used grade of these alloys are shown in Table 1. These alloys are widely used as glass-to-metal or ceramic-to-metal seals due to their low thermal coefficient of expansion which matches well with that of glass and ceramics. These alloys are conventionally made by fusion metallurgy, although commercial powder metallurgy processes for making them in strip form exist.

As noted in Table 1, the electrical conductivity of Alloy 42 (another nickel/iron alloy containing 42% Ni) is quite low in comparison with copper and copper alloys. However, these alloys are used in electronics industry as lead frames because of the need for matching low coefficient of thermal expansion with that of silicon chips and with the ceramic package or encapsulation. The electronics industry also uses copper and copper alloys for the lead frame application, especially when epoxy encapsulations are permissible. Use of copper or copper alloy lead frames is beneficial due to the high electrical and thermal conductivity of copper. However, copper, copper alloys, aluminum or silver, while relatively highly conductive, have a high coefficient of thermal expansion. The high thermal conductivity helps in rapid dissipation of heat from the electronic chips during their use. At present, selection of strip material for lead frame fabrication involves sacrifices in either the thermal (and electrical) conductivity, or in the matching of coefficient of thermal expansion with silicon and ceramic components. Some attempts have been made by other workers to develop a stainless steel/copper composite to arrive at optimum desired strength properties. So far these composites have not found much acceptance in the industry.

The present invention provides a means of achieving both high electrical (and thermal) conductivities and improved mechanical and/or physical properties, e.g., a low coefficient of thermal expansion, in a single material which is a composite of a hard metal or hard metal alloy component and a dispersion strengthened metal component. The relative volume of each of the two components can be varied to obtain specific combination of the desired properties. Examples provided in this application show some of these properties.

A principal advantage of the present invention is that it provides the art with a means for utilizing copper, aluminum, silver, etc., and the relatively high electrical and/or thermal conductivity thereof in a system with nevertheless has good mechanical properties, e.g., strength, dimensional stability, etc. Usually the blending of such conductive metal with a foreign metal, results in a severe loss of conductivity, thermal and/or electrical, because of diffusion of the foreign metal into the copper. In the present case, the presence of a very highly dispersed refractory metal oxide in a dispersion strengthened metal, while causing some reduction in conductivity, yields a stronger, unsintered, fully densified, conductive component which has its mechanical properties enhanced by a second metal or metal alloy component as a composite structure distinct from a highly alloyed or interdiffusion product of the two components.

For making the composite material strips, at least two processes have been tried and found satisfactory. One of the two methods is powder metallurgy extrusion of a blend of an alloy powder and dispersion strengthened power, e.g., Invar type alloy and DSC. Extrusion can be effected by using a copper billet container. The billet container becomes a cladding on the composite material rod or strip extruded and is beneficial from the point of view of high electrical conductivity. The extruded strip can then be rolled to the desired gage.

Another satisfactory process is rolling of a flat billet container filled with a blend of the two powders. The billet container can be of copper, as in extrusion, if additional high electrical conductivity is considered beneficial. Examples covered herein are based on the foregoing processes for the strip product.

The present invention is directed also to composite wires whose principal constituents are hard metal or hard metal alloys, e.g., nickel/iron alloys and DSC. The benefits of this combination are achievement of low coefficient of thermal expansion, or dimensional stability, and high electrical conductivity and thermal conductivity. Optimum levels of these two properties can be obtained by proper selection of the relative volume of the two constituents for any given application. The desirability of such combination of properties is based again on the need for achieving hermetic seals with glass or ceramic components and at the same time the need for achieving higher electrical and thermal conductivities in one material. The electronics industry would find the composites hereof useful in diode lead wires. Besides potential uses in various electronic components, such wires simplify the fabrication of incandescent light bulbs by replacing both the 'dumet' (42% Ni, bal. Fe) wire and the DSC lead wire segments. At present, the lead wire system of a light bulb consists of three different wire segments. The portion of the lead wire that supports the tungsten filament is made of dispersion strengthened copper (or another high temperature copper alloy) wire. This wire is attached to the tungsten filament on one end and the other end is welded on to a 'dumet' wire segment. The dumet wire is essentially an Invar type alloy (42% Ni) wire with a coating (or plating) of copper. The dumet wire passes through the evacuation stem of the bulb where it makes a hermetic seal, and its other end is welded on to a plain copper wire segment which connects to the electrical terminals of the light bulb.

The requirements for these three wire segments are somewhat different from each other. The DSC lead wire is required to conduct the electric current to the filament and at the same time retain its mechanical strength despite the high temperatures encountered in the stem pressing (glass to metal sealing) operation during manufacture and in the vicinity of the tungsten filament during use. The dumet wire segment permits the lead wire system to be hermetically sealed within the glass stem with a compatible coefficient of expansion, so as to retain the back filled inert gas in the light bulb and also to carry current satisfactorily. The copper wire segments connect the terminal to the dumet wire segments and are only required to be efficient conductors of electricity. The use of a single composite wire made of DSC and an Invar type alloy satisfies the requirements for all three segments of the lead wire system. A comparison of electrical resistance of the present composite lead wire system with that of the current commercial design is shown below. Substitution of the currently used segmented structure by a single composite wire formed as herein described eliminates the need for welding the dumet wire segment to a dispersion strengthened copper wire segment on one side, and copper wire on the other.

The use of DSC is preferred over other copper alloy wires, such as Cu-Zr, because DSC wire has adequate stiffness to enable elimination of molybdenum support wires for the tungsten filament. This can be embodied easily with the composite wire system of this invention since the strength and stiffness retention of composite wire are similar to those of DSC lead wires. Newer bulbs are being made without nickel plating. By using a small amount of boron in the DSC, oxygen problems can be eliminated.

The processes for making the composite wire include extrusion of a round rod, followed by wire drawing, and swaging of a copper or nickel tube filled with a blend of DS copper powder and Invar type powder followed by drawing.

Figure 1:
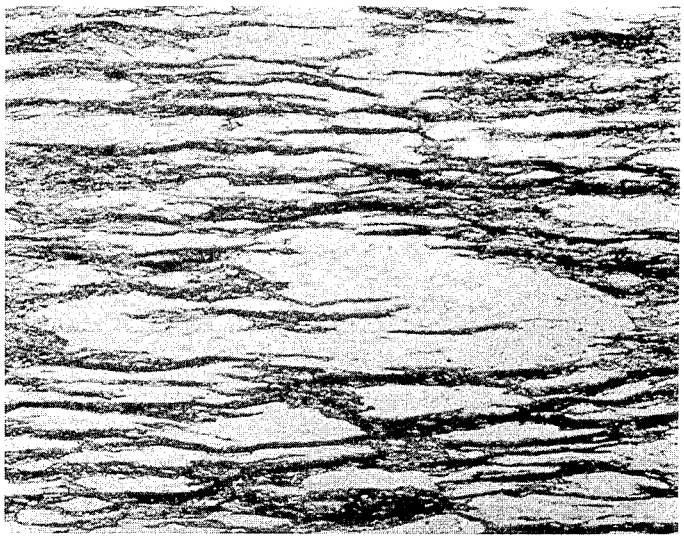
FIG. 1 is a photomicrograph of a section showing a plain copper/Nilvar 50:50 blend treated according to Example IX below.
Figure 2:
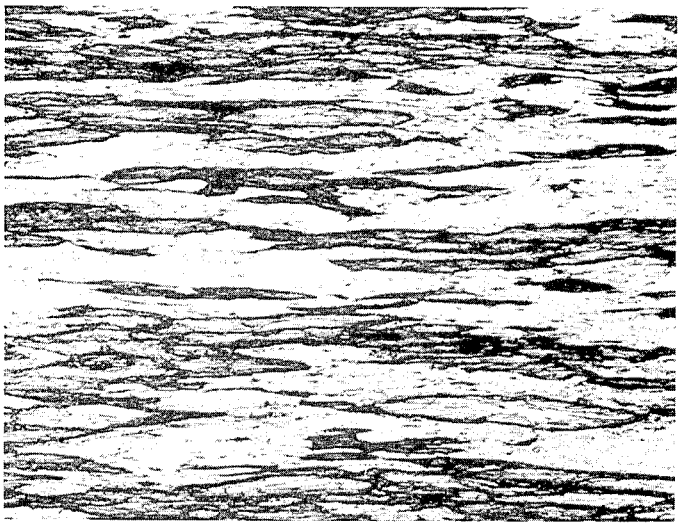
FIG. 2 is a photomicrograph of a section showing a dispersion strengthened copper/Nilvar 50:50 blend treated according to Example IX below.

As indicated above, FIGS. 1 and 2 are photomicrographs at the same magnification of a longitudinal section of a fully densified plain copper composite and a fully densified dispersion strengthened copper composite, respectively all other factors being same. The large particles in each figure (light gray) are the Nilvar; the dark portions are the softer copper or DSC, respectively. Note the large central particle in FIG. 1. This is typical of the results when there is maximum disparity in the hardness of the ingredients, i.e., as in the case of plain copper and Nilvar. In the case of DSC, the relative hardnesses of the ingredients are closer together, and the photomicrograph of FIG. 2 is typical and shows a higher degree of interspersion of the DSC with the Nilvar. It is clear that the interfacial surface area of the ingredients in FIG. 2 is much greater than in FIG. 1. The opportunity for interfacial diffusion in the composite is thus much greater in the DSC composite than in the plain copper composite. As is known, the greater the extent of interdiffusion, the lower the conductivity. One expects, therefore, that the composite of FIG. 1 would have higher conductivity because of the lower opportunity for interfacial diffusion. Surprisingly, as is seen in Table 8 below, the conductivity of the DSC composites is better than the conductivity of the plain copper composites. The mechanical properties of the DSC composites are also superior to those of the plain copper composites.

The particles are in the main discrete. Interdiffusion can occur in both cases at the interface between the hard metal and the copper or DSC, as the case may be. However, although one would expect higher interdiffusion in the case of the more finely subdivided dispersion strengthened metal composites because of the increased interfacial area and concomitant lower conductivity, this is not observed. The highly dispersed microparticulate refractory oxide resulting from internal oxidation acts as a barrier and inhibits interdiffusion or alloying whereby electrical conductivity is preserved, and at the same time the law of mixtures is allowed to function to a higher degree whereby the mechanical properties conferred by the hard metal or hard metal alloy are preserved to a maximum extent. The relative extents of interdiffusion or alloying can be verified by Auger analysis.

Figure 4:
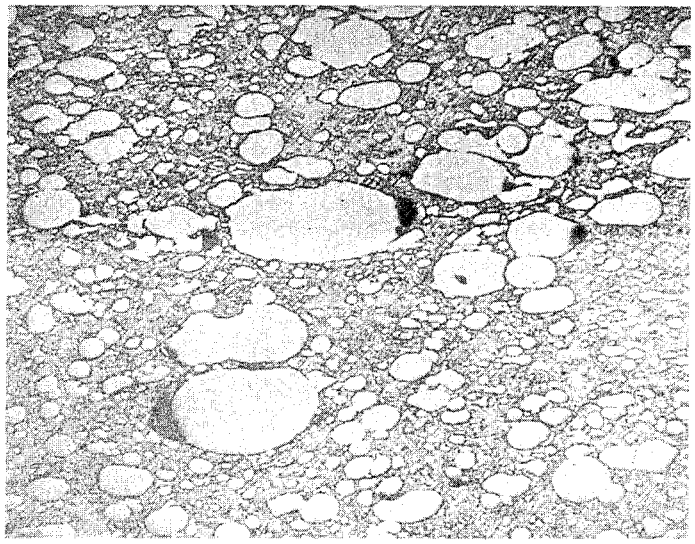
FIG. 4 is a photomicrograph of a longitudinal section of electrolytic copper/Alloy 42 rod shown in FIG. 3 extruded at 1450° F. according to Example X below.

FIGS. 4 and 8 also illustrate the same phenomenon as described above. FIG. 4 is plain copper and FIG. 8 is DSC. Note that in FIG. 4 the hard metal alloy particles (light gray) are not substantially deformed. Hence, their surface areas have not changed. In FIG. 8 there is substantial deformation and fiberizing of the hard metal alloy. This increases the interfacial surface area and increases the opportunity for interdispersion of the respective components as above described.

Example I below represents the best embodiment of our invention presently known to us, and the best mode of making such embodiment.

EXAMPLE I

Sixty-two grams of GlidCop AL 20 powder, screened to −80/+400 mesh fraction, were thoroughly mixed with 186 grams of −80/+400 mesh fraction of an Invar powder. The chemical composition of the Invar alloy powder was 42% nickel, 0.32% manganese, 0.01% carbon and the balance iron. Mixing was carried out in a double cone blender for a period of 30 minutes. A welded copper extrusion can, measuring 1⅜" in diameter (O.D.)×2¼" in length, with a ¼" O.D.×½" long fill tube, was filled with the above powder mix. The fill tube opening of the billet can was then closed tightly. The powder filled billet was then heated in a nitrogen atmosphere furnace at a temperature of 1550° F. for 45 minutes, and then the hot billet was extruded in an extrusion press, using a rectangular cross-section die-insert. The cross-section of the extruded bar measured 0.50×0.188", with rounded corners, and the extrusion ratio was 16:1. The extrusion die preheat temperature was 900°-50° F. The extrusion pressure was 45 tons/square inch. The extruded bar was cut up into 6" long pieces. One of these pieces was used for the measurement of electrical conductivity, using a Kelvin Bridge (Leeds & Northrup Model #4306). The other pieces were cold rolled to a thickness of 0.100" and annealed at this size, at a temperature of 1500° F. for 30 minutes in nitrogen atmosphere. These strips were then rolled to 0.01" and 0.02" gage strips. Some strips were annealed again at 1450° F. temperature for 30 minutes in nitrogen atmosphere. All strips were tensile tested by using ASTM specimen dimensions. The results are shown in Table 2 below.

EXAMPLE II

The process utilized here was essentially the same as in Example I, except that here the extrusion billet was filled with Invar (42% Ni) powder only. Two hundered and fifty grams of Invar powder having the same chemical composition and mesh fraction, as in Example I were used. No DSC or any other powder was mixed with it. The extruded bar consisted of an Invar core with a plain copper cladding, which was rolled down to 0.01" gage strip for determining the mechanical properties at that gage. Mechanical properties were measured on an extruded bar, as in Example I. The results of the tests are shown in Table 2 below.

EXAMPLE III

A 1½" diameter copper tube having a wall thickness of 0.065" was formed into a flat tube, by rolling, having dimensions of 2.0" wide×0.6" thick×12" in length. This tube was then filled with Invar powder (42% Ni) (−80/+400 mesh fraction) and the ends of the tube were closed. The tube was then cold-rolled to 0.30" in thickness, by taking 15% reduction per pass. At this point, the billet was heated in Nitrogen atmosphere furnace at a temperature of 1600° F. and then hot-rolled, taking 25% to 20% reductions per pass. Four hot rolling passes were given to the billet, resulting in a thickness of 0.10". The strips were then cold rolled to 0.05" in thickness. Tensile tests were carried out at this gage. The data are shown in Table 2 below.

EXAMPLE IV

The process utilized here was essentially the same as in Example I, except for that the extrusion billet can was filled with a 50—50 mixture of GlidCop AL 20 and Invar 42% Ni powders. One hundred and twenty five grams of each of these two types of powder having particle size of −80/+400 mesh were used. The extruded bar was rolled to 0.030" thick strip. Two specimens were tested for mechanical strength in the as-rolled or cold-worked condition and the other specimens were annealed at 1450° F. for 30 minutes in nitrogen atmosphere prior to tensile test. The results are shown in Table 2 below. Electrical conductivity was also measured for this bar, using the same technique as in Example I.

TABLE 2

DATA FROM EXAMPLES I THRU IV: STRIP SAMPLES

| Example # | Material | | Metallurgical Condition | Gage | ksi U.T.S. | ksi Y.S. | % Elong. |
|---|---|---|---|---|---|---|---|
| I | Cladding-Copper | (15%) | C. W. - 90% | .010" | 123.8 | 119.2 | 3 |
| (Extruded) | Core - GlidCop | (25%) | C. W. - 84% | .030" | 101.6 | 96.4 | 4 |
| | - Invar* | (75%) | Annealed | .030" | 72.7 | 60.5 | 19 |
| II | Cladding-Copper | (12%) | C. W. - 80% | .018" | 105.3 | 98.3 | 3 |
| (Extruded) | Core - Invar* | (100%) | Annealed | .018" | 75.0 | 39.8 | 28 |
| III | Cladding-Copper | (24%) | C. W. - 30% | .050" | 97.0 | 89.3 | 5 |
| (Packrolled) | Core - Invar* | (100%) | Annealed | .050" | 60.0 | 32.2 | 32 |
| IV | Cladding-Copper | (15%) | C. W. - 84% | .030" | 93.4 | 89.2 | 4 |
| (Extruded) | Core - GlidCop | (50%) | Annealed | .030" | 71.0 | 57.1 | 22 |
| | - Invar* | (50%) | | | | | |

Electrical conductivity of a sample from Example I was determined to be 39.3% IACS or 4.4 microhm-cm; for Example IV sample conductivity was 47% IACS or 3.7 microhm-cm.
*42% Ni, bal. iron and impurities A composite wire made up of DSC and an Invar type alloy component would have a higher modulus of elasticity than DSC. The modulus of elasticity of DSC is $16\times10^6$ psi. Except for berylliumcopper alloys and high nickel containing copper alloys, other alloys of copper have modulus of elasticity not exceeding $17\times10^6$ psi. The modulus of elasticity of Invar type alloys range from $24\times10^6$ to $29\times10^6$ psi. Because in the present composite systems the modulus of elasticity obeys the rule of mixtures, a system consisting of DSC and an Invar type alloy would typically have modulus of elasticity in the range of 18 to $22\times10^6$ psi, which is significantly higher than most copper alloys. The higher modulus of elasticity and the higher tensile strength of the composite, over those of DSC alone enables reduction of the diameter of the lamp lead wire provided that electrical conductivity of the lead wire is acceptable.

The lower thermal conductivity of the composite lead wire (both in the standard size of 0.014" dia. (and smaller if permissible) reduces the rate of heat transfer from the filament to the bulb stem. This results in greater reduction of energy consumption rate of the light bulb for the same amount of light output.

EXAMPLE V

Using the process described in Example I, substantially the same results are obtained when a tin-containing dispersion strengthened copper alloy (2% Sn, 0.2% Aluminum) is used in place of the GlidCop AL 20.

Other dispersion strengthed alloys of copper may be used herein in the same manner as shown in Examples I and V. Dispersion strengthened copper is present in these alloys in an amount ranging from 50% to 99% by weight. The extent of refractory metal oxide, e.g., alumina, calculated as the metal equivalent, e.g., aluminum, is in the range of 0.05% to 5%, preferably 0.1% to 0.65%. Suitable alloying metals include tin, zinc, tin/-zinc mixtures, silicon, magnesium, beryllium, zirconium, silver, chromium, iron, nickel, phosphorus, titanium, samarium, and mixtures of two or more such elements. The alloys can be prepared by conventional melt techniques followed by conventional atomization technology, by uniformly blending powders of DSC and the alloying metal followed by diffusion treating to accomplish alloying and then densifying the alloy to form a dispersion strengthened copper alloy.

Because these components are in series, the total resistance is the sum of the resistances of the three components, which is: 23,617 microhms.

A 60 watt General Electric lightbulb was found to have a lead wire system which was similar to the 75 watt bulb, except for a thinner GlidCop wire. The diameter of the GlidCop wire here was only 0.012" or 0.03048 cm. The resistance of the GlidCop component here is 10103 microhms. Hence, the total resistance of the leadwire is 26,311 microhms. (These values do not take into account the resistances that may result from the welded joints).

Using the composite wire concept, two examples having comparable overall electrical resistance are shown below. In both of these examples copper clad lead wire having 0.015" diameter, with a core consisting of 70% by volume Invar (42% Ni) and 30% by volume GlidCop (AL20) are considered. However, a higher GlidCop or DSC content such as 40% or 50%, or a thicker copper cladding can be utilized, which would permit the reduction of the composite wire diameter (from the 0.015" used in the examples), while keeping the overall resistance of the lead wire system in the acceptable range. In one case, the copper cladding's thickness is 0.00035". In the former case, replacement of the entire lead wire system with the composite wire is determined to be feasible, whereas in the latter case, only the GlidCop and dumet portions could be replaced to arrive at the same overall resistance.

A 75 watt light bulb made by General Electric was found to have a lead wire consisting of three different segments connected in series. The constituents of these elements and their dimensions are shown below in Table 3. Table 3 also shows the electrical resistance of these three components.

TABLE 3

DIMENSIONS AND RESISTANCE OF VARIOUS COMPONENTS OF LEAD WIRES IN 75 WATT LIGHT BULB

| Component | Length (cm) | Diameter (cm) | Area of Cross-Section ($cm^2$) | Resistivity Microhm-cm | Resistance Microhm |
|---|---|---|---|---|---|
| GlidCop (AL 20) | 3.80 | .0356 (.014") | .000995 | 1.95 | 7409 |
| Dumet | 1.31 | Total - .037 | .001075 | — | 9401* |
| | | Core - .033 | .000855 | 80.0 | (122573) |
| | | Clad | .000220 | 1.71 | (10182) |
| | | Thickness - .002 | | | |
| Copper | 2.89 | .0304 | .000726 | 1.71 | 6807 |

*Overall Resistance of dumet component is given by $\frac{Rcore \times Rclad}{Rcore + Rclad}$

| Overall diameter of composite wire - .015" or .0381 cm. | | |
|---|---|---|
| Core | .013" in diameter | consisting of 70% Invar + 30% GlidCop (AL20) |
| Cladding | .001" in thickness | copper |
| Length | 8.0 cm, for all three components. | |
| | Areas of cross section of various components: | |
| Core (Total) | | .0008563 sq. cm. |
| Invar | | .000599 sq. cm. |
| GlidCop | | .0002573 sq. cm. |
| Copper Cladding | | .0002838 sq. cm. |
| Resistance of Glidcop | | 60318 microhms |
| Resistance of Invar | | 1066667 microhms |
| Resistance of Copper | | 48203 microhms |
| Resistance of Core | | 57089 microhms |
| Resistance of Lead Wire | | 26135 microhms |

| | | |
|---|---|---|
| Overall diameter of composite wire | .015" or | .3818 cm |
| diameter of composite core | .0143" or | .03632 cm |
| cladding thickness | .00035" or | .00089 cm |
| The length of composite wire | 5.11 cm | |

The balance of lead wire or 2.89 cm will be of copper having 0.015" (or 0.0381 cm) diameter.

| Component | Area of Cross-Section sq. cm | Resistivity microhm - cm | Resistance microhm |
|---|---|---|---|
| Invar (42% Ni) | .000725 | 80 | 563862 |
| GlidCop | .000311 | 1.94 | 31875 |
| Copper Cladding | .0001038 | 1.71 | 84157 |
| Copper Wire | .001140 | 1.71 | 4335 |
| Resistance of Core - 30169 | | | |
| Net Resistance of Composite Wire = 22207 | | | |

Adding the resistance of copper wire, total resistance will be 26,542 microhm.

Examples VI and VII illustrate the concept of using a composite wire made up of Invar and GlidCop for lamp lead wire. The actual proportions of the two main components may be adjusted to arrive at the most suitable composite. Because the tensile strength of Invar (42% Ni) is greater than that of GlidCop, no loss of strength is anticipated in these composites over regular all-GlidCop lead wires.

EXAMPLE VIII

The consolidation process employed here was essentially the same as Example I, except the extrusion billet was filled with various mixtures of GlidCop AL 15 and Nilvar (36% Ni, bal. Fe) powders. A particle size of −20 mesh was used. The resulting billets were extruded through a round cross sectional die insert with a diameter of 0.250 inches for an extrusion ratio of 30:1. The rods then underwent a series of size reductions being 20% cross sectional reduction per pass to a final 0.014 inch diameter wire. Specimens with a ten inch gauge length were mechanically tested in the as drawn condition and annealed condition using a nitrogen atmosphere. The results appear in Table 4.

EXAMPLE IX

This test illustrates the importance of using dispersion strengthened copper powder, as opposed to plain copper powder, in a powder blend with Nilvar (36% Ni) to form a low expansion composite. The comparison is based on one method of consolidation.

The test started by blending two 50/50 mixtures; one of AL 15 with Nilvar the other of plain copper with Nilvar. Both the copper powders were finer than 170 mesh before blending.

Each powder blend filled a two feet long copper tube 1.5 inches in outside diameter with a 0.032 inch wall thickness. Both rods were cold swaged to a 0.975 inch diameter, sintered for one hour at 1650° F. in nitrogen, and further cold swaged to a 0.465 inch diameter. All cross sectional reductions occurred at room temperature.

Metallographic examination at the 0.465 inch diameter in the longitudinal direction showed that both rods achieved crack free full density. However, the microstructures were different. In one rod the soft copper particles deformed more than the relatively harder Nilvar particles to leave fibers of copper surrounding less elongated islands of Nilvar. See FIGS. 1 and 4. The structural disparity between the constituents resulted from the mechanical disparity between the constituents. In contrast, the GlidCop particles deformed about as much as the similarly hard Nilvar particles to produce laminae of Glidcop and Nilvar. See FIGS. 2 and 8. The structural parity between the constituents resulted from the mechanical parity between the constituents.

When the rods were utilized for a 20% cross sectional reduction by drawing the copper containing rod failed. The GlidCop containing rod did not. This difference in workability is believed to be due to the mechanical, hence structural, parity between the constituents.

TABLE 4

MECHANICAL PROPERTIES OF COMPOSITES

| EXAMPLE | COMPOSITION | DIAMETER (INCHES) | ANNEAL TEMPERATURE (F.) | U.T.S. (KSI) | ELONGATION % |
|---|---|---|---|---|---|
| VIII(a) | 75% AL-15 + 25% Nilvar | .014 | As Drawn | 112 | — |
| | | | 600 | 99 | — |
| | | | 1200 | 85 | 4 |
| | | | 100 | 78 | 9 |
| VIII(b) | 50% AL-15 + 50% Nilvar | .014 | As Drawn | 122 | — |
| | | | 600 | 109 | — |
| | | | 1200 | 90 | 2 |
| | | | 1800 | 72 | 7 |
| VIII(c) | 25% AL-15 + 75% Nilvar | .014 | As Drawn | 140 | — |
| | | | 600 | 122 | — |
| | | | 1200 | 91 | 1 |
| | | | 1800 | 66 | — |

The following Examples X and XVII inclusive are to be read in conjuction with FIGS. 3 to 13 comparing composites of this invention with plain copper composites, with and without sintering.

EXAMPLE X

Figure 3:
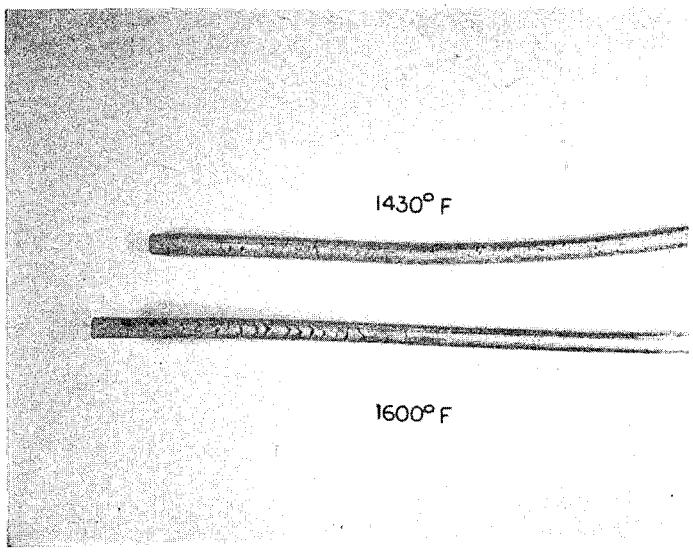
FIG. 3 is a photograph showing electrolytic copper-/Alloy 42 composite rods extruded at 1450° F. and 1600° F., respectively, according to Example X below.
Figure 5:
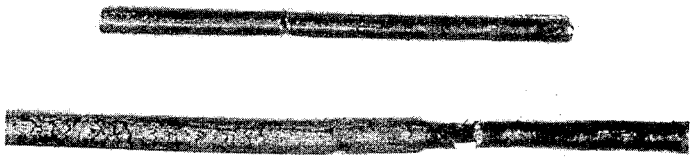
FIGS. 5 and 6 show the condition of the rods extruded at 1450° F. and 1600° F. respectively, when it was attempted to draw into wire according to Example X below.
Figure 6:
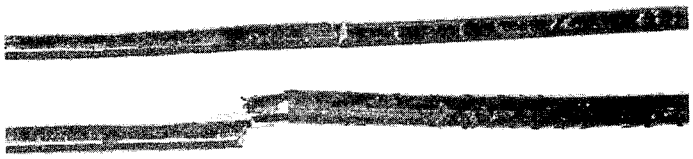

A fifty-fifty mixture of electrolytic copper (EC) powder and nickel/iron Alloy 42 powder was blended for 30 minutes in a double-cone blender. The particle size distributions of the two types of powders are shown in Table 5. Two copper extrusion billet cans measuring 1.40" in diameter and 2.0" in length were filled with the blended mixture. The two billet cans were hot extruded to 0.25" diameter round rods, after pre-heating at temperatures of 1450° F. and 1600° F., respectively. (It may be noted here that these two temperatures signify the practical upper and lower limits for hot extrusion of copper-base materials). The extrusion die temperature was 1000° F. for both. The as-extruded rods showed cracks as shown in FIG. 3. These cracks were transverse in nature and were severe enough to tear open the copper cladding. Metallographic examination of the longitudinal sections of the two rods showed that the Alloy 42 powder particles remained essentially undeformed during extrusion and voids were formed adjacent to these particles as the softer copper flowed around these. FIG. 4 is a photo-micrograph of a longitudinal section of rod extruded at 1450° F. The 1600° F. extruded rod showed worse cracking than the 1450° F. extruded rod. Both rods were sent to an outside film for wire drawing. Attempts to draw these were unsuccessful, as these rods broke under the tensile forces of the drawing operation in the very first drawing pass. FIGS. 5 and 6 show the condition of the rods after the wire drawing attempt.

EXAMPLE XI

A fifty-fifty mixture of GlidCop (AL 15) powder and Alloy 42 was blended for 30 minutes in a double-cone blender. The particle size distributions of the two types of powders are shown in Table 5. Two copper extrusion billet cans measuring 1.40" in diameter and 2.0" in length were filled with the blended mixture. The two billet cans were hot extruded to 0.25" diameter round rods after pre-heating at temperatures of 1450° F. and 1600° F., respectively. The extrusion die temperature was 1000° F. for both. The as-extruded rods did not show any cracks, as shown in FIG. 7. Metallographic examination of longitudinal sections of the two rods showed that the Alloy 42 powder particles had undergone as much deformation as the GlidCop particles had and no voids were present in the material. FIG. 8 is a photomicrograph of a longitudinal section of the rod extruded at 1450° F. Both rods were sent to an outside firm for wire drawing. These were successfully drawn down to 0.010" diameter wires. FIG. 9 is a picture of the rod after two drawing passes and of the finished wire.

EXAMPLE XII

Here an extrusion was performed using the same powder mixture and the same process parameters as used in Example X, except that the extruded rod had a rectangular cross-section measuring 0.50"≦0.125". Extrusion temperature was 1450° F. The as-extruded strip showed light cracks on the edges. The microstructure of the longitudinal section of the as-extruded strip was similar to FIG. 4. Attempts were made to cold roll the strip but edge cracks became severe when 0.043" thickness was reached and further rolling was not undertaken. FIG. 10 is a photograph of the strip at 0.043" thickness.

EXAMPLE XIII

The process carried out here is similar to that in Example XII, except that GlidCop AL 15 powder was used here instead of Electrolytic Copper powders. The particle size distribution of the GlidCop powder is shown in Table 5. The extruded strip was sound in all respects and was rolled down to 0.010" in thickness. FIG. 11 is a photograph of a sample of the strip. The mechanical properties were determined, which are similar to those shown in Table 7, below.

EXAMPLE XIV

Electrolytic Copper powder and Alloy 42 powder were blended in a ball mill for one hour. The particle size distributions of the two types of powder are shown in Table 5. The blended mixture was pressed into bars measuring 0.40" in thickness, using 99 ksi of pressure. The bars were sintered at 1850° F. for 3 minutes in hydrogen atmosphere. The bars were then rolled to 0.20" in thickness, taking 10% reduction per pass. The bars were resintered at the same temperature for 3 minutes in hydrogen atmosphere and then rolled to 0.1" thickness. The strip obtained was extremely brittle and had developed transverse cracks, mainly at the edges. FIG. 12 is a photograph of this strip.

EXAMPLE XV

Here the process followed and the process parameters used were identical to Example XIV, with the exception that GlidCop AL 15 powder was used instead of electrolytic or pure copper powder. The particle size distribution of GlidCop AL 15 powder was similar to the particle size distribution of the Alloy 42 powder. The pressed and sintered bars did not sinter well enough to permit rolling beyond 2 passes. FIG. 13 is a photograph of the bars.

EXAMPLE XVI

A fifty-fifty mixture of GlidCop AL 15 powder and Alloy 36 powder was blended in a double-cone blender for 30 minutes. The particle size distribution for both powders are shown in Table 6. The mixture was pressed into 0.09" thick bars having a density of 92% of the full-theoretical density. The bars were then sintered at 1850° F. in nitrogen atmosphere for 40 minutes. These were then cold rolled by 50% and then resintered at 1800° F. for 40 minutes. Then they were rolled to 0.010" in thickness. Tensile tests were performed in the as-rolled condition and after annealing at 1600° F. for 30 minutes in nitrogen atmosphere. These results are shown in Table 8.

TABLE 5

PARTICLE SIZE DISTRIBUTIONS OF POWDERS USED IN EXAMPLES X THROUGH XV

| Particle Size (Screen Mesh) | WEIGHT PERCENT Powder Type: Electrolytic Copper | Alloy 42* | GlidCop AL 15 |
|---|---|---|---|
| >80 | 5 | 20.5 | 20.5 |
| 80-100 | 5 | 8.5 | 8.5 |
| 100-140 | 5 | 15.0 | 15.0 |
| 140-200 | 5 | 21.5 | 21.5 |
| 200-325 | 80.0 | 17.0 | 17.0 |
| <325 | 15.0 | 17.5 | 17.5 |

*40% Ni, bal Fe

TABLE 6

PARTICLE SIZE DISTRIBUTIONS OF POWDERS USED IN EXAMPLES XVI AND XVII

| Particle Size (Screen Mesh) | WEIGHT PECENT Powder Type: Electrolytic Copper | Alloy 36* | GlidCop AL 15 |
|---|---|---|---|
| 40-60 | — | 20.5 | 20.5 |
| 60-120 | — | 36.0 | 36.0 |
| (70-170) | 41.5 | — | — |
| 120-200 | — | 19.0 | 19.0 |
| 200-270 | — | 10.0 | 10.0 |
| (170-325) | 40.5 | — | — |
| 270-325 | — | 2.5 | 2.5 |
| <325 | 18.0 | 12.0 | 12.0 |

*36% Ni, bal. Fe

EXAMPLE XVII

The process followed and the process parameters used were identical to those used in Example XVI, except for that electrolytic copper powder was used here instead of GlidCop AL 15. The particle size distribution of electrolytic copper is shown in Table 6 above. Pressed and sintered bars were rolled down to 0.010" and then tensile tested. The results are shown in Table 7 below.

TABLE 7

MECHANICAL PROPERTY DATA EXAMPLES XVI AND XVII

| Samples from | Condition | Ultimate Tensile Stress K.S.I. | Yield Stress K.S.I. | Elongation % |
|---|---|---|---|---|
| Example XVI | As Rolled | 111.6 | 105.0 | 4.4 |
| Example XVI | Annealed | 88.3 | 84.5 | 12.3 |
| Example XVII | As Rolled | 78.0 | 77.0 | 3.5 |
| Example XVII | Annealed | 50.5 | 33.2 | 10.6 |

The following four examples further emphasize the advantages of dispersion strengthened metal composites over plain metal composites, and illustrate the desirability of matching mechanical strengths of the two principal components. Plain copper powder mixed with Alloy 42, for example, in a composite does not make a sound Powder Metallurgy (P/M) extrusion whereas aluminum oxide dispersion strengthened copper does. Plain copper powder when mixed with Alloy 36 does, however, make reasonably sound P/M extrusions. This is apparently due to the lower strength of Alloy 36 when compared to Alloy 42; i.e., the closer matching of strength properties does affect the product obtained. Rectangular cross-section extrusions made using a blend of plain copper powder and Alloy 36 did not show voids or cracks although the Alloy 36 particles did not deform as much as the particles of plain copper powder. The powder treatment procedure followed in these examples is as set forth in Example I.

EXAMPLE XVIII

Comparative Low Expansion composites following the procedure of Example I were made using the following compositions:

| | | | |
|---|---|---|---|
| (A) | GlidCop AL-15 | (−200 mesh) | 50% by weight |
| | Alloy 36 | (−40 mesh) | 50% by weight |
| (B) | Electrolytic Copper | (−200 mesh) | 50% by weight |
| | Alloy 36 | (−40 mesh) | 50% by weight |

The mechanical properties of both samples hot swaged and both samples hot extruded are presented in Table 8 below. The columnar abbreviations have the following meanings: UTS=ultimate tensile strength. YS=yield strength. ΔA%=% reduction in area (a measure of ductility). ΔLS%=% elogation measured from specimen. $H_B$ is hardness compared to a standard. IACS is International Annealed Copper Standard. (See Kirk-Othmer, Encyclopedia of Chemical Technology, Second Edition, Vol. VI, Interscience Publishers, Inc. 1965, page 133). $\alpha \times 10^6$/°C. is the coefficient of thermal expansion. This shows that GlidCop composites have higher conductivity than copper composites illustrating that alloying retards conductivity.

TABLE 8

COMPARISON OF DSC WITH PLAIN COPPER USING THE FOLLOWING COMPOSITIONS

| | | | |
|---|---|---|---|
| (A) | AL-15 | (−200 mesh) | 50 wt. % |
| | Alloy 36 | (−40 mesh) | 50 wt. % |
| | Elec. Cu | (−200 mesh) | 50 wt. % |

TABLE 8-continued

COMPARISON OF DSC WITH PLAIN COPPER USING THE FOLLOWING COMPOSITIONS

| (B) | | Alloy 36 | | (−40 mesh) | | | 50 wt. % | |
|---|---|---|---|---|---|---|---|---|
| CONDITION | MIX | UTS psi | YS psi | ΔA % | ΔLS % | $H_B$ | IACS % | $\alpha \times 10^6$/°C. |
| As swaged | A* | 92,200 | 87,000 | 26.9 | 12.2 | 87 | — | — |
| 0.625" ϕ | B* | 81,000 | 74,900 | 32.8 | 14.0 | 76 | — | — |
| As drawn | A* | 103,200 | 98,400 | 37.2 | 12.7 | 85 | 15.0 | — |
| 0.244" ϕ | B* | 95,400 | 88,700 | 21.5 | 8.0 | 83 | 11.3 | — |
| 0.224" ϕ | A° | 92,000 | 80,600 | 47.3 | 25.9 | 79 | — | — |
| Annealed (1200° F.) | B° | 70,900 | 56,800 | 53.8 | 28.1 | 61 | — | — |
| As extruded | A** | 68,300 | 51,600 | 59.7 | 29.5 | 72 | 9.4 | 12.7 |
| 0.265" ϕ | B** | 63,100 | 46,900 | 64.0 | 28.4 | 56 | 6.3 | 13.9 |
| As drawn | A** | 124,000 | 119,300 | 21.2 | 2.5 | — | — | — |
| 0.014" ϕ | B** | 127,000 | 125,000 | 25.1 | 2.3 | — | — | — |
| 0.014" ϕ | A** | 88,300 | 73,800 | 22.5 | 8.1 | — | — | — |
| Annealed (1200° F.) | B** | 81,600 | 72,100 | 37.4 | 3.5 | — | — | — |
| 0.014" ϕ | A** | 73,600 | 62,800 | 51.5 | 11.7 | — | — | — |
| Annealed (1600° F.) | B** | 65,700 | 54,700 | 65.4 | 15.4 | — | — | — |

*Hot Swaged
**Hot Extruded

EXAMPLE XIX

To study the effect of particle size and the presence or absence of cladding on extruded compositions in accordance with this invention. The compositions studied were as follows: All mesh sizes are U.S. Standard Screen sizes. The conductivities are set forth in Table 9 below.

| | | | |
|---|---|---|---|
| (C) | GlidCop AL-15 | (−200 mesh) | 50% by weight |
| | Alloy 36 | (−40 mesh) | 50% by weight |
| (D) | GlidCop AL-15 | (+200 mesh) | 50% by weight |
| | Alloy 36 | (+200 mesh) | 50% by weight |

TABLE 9

| COMPOSITION | MESH SIZE | CLADDING | % IACS |
|---|---|---|---|
| C | −200, −40 | NO | 9.4 |
| C | −200, −40 | YES | 22.0 |
| D | +200, +200 | NO | 15.0 |
| D | +200, +200 | YES | 30.8 |

Coarser particle size of the GlidCop AL 15 tends to reduce diffusion and give better conductivity. The presence of cladding also increases conductivity significantly.

Sample D also showed a UTS=65,000 psi, a YS of 50,000 psi; a ΔA% of 60.7%; a ΔLS% of 16.4% and a hardness of 68.8. Compared with Sample A as extruded in Table 8, it will be seen that the coarser powder of sample D shows a reduction in the loss of strength compared to copper containing composites.

EXAMPLE XX

Comparative low expansion composites were made using the following compositions: The results are in Table 10.

| | | | |
|---|---|---|---|
| (E) | GlidCop AL-15 | (−200 mesh) | 50 vol. % |
| | Alloy 42 | (−40 mesh) | 50 vol. % |
| (F) | GlidCop AL-15 | (−20 mesh) | 50 vol. % |
| | Alloy 42 | (−20 mesh) | 50 vol. % |
| (G) | GlidCop A-15 | (−200 mesh) | 25 vol. % |
| | Alloy 42 | (−40 mesh) | 75 vol. % |
| (H) | GlidCop AL-15 | (−20 mesh) | 25 vol. % |
| | Alloy 42 | (−20 mesh) | 75 vol. % |

TABLE 10

| COMPOSITION | MESH SIZE | UTS | YS | ΔA | ΔLS | $H_B$ | IACS % |
|---|---|---|---|---|---|---|---|
| E | −200, −40 | 68700 | 55400 | 40 | 17.9 | 74.1 | 7.9 |
| F | −20, −20 | 66900 | 49200 | 47.3 | 30.0 | 72.5 | 9.5 |
| G | −200, −40 | 67700 | 52100 | 40.2 | 18.4 | 72.5 | 4.8 |
| H | −20, −20 | 67200 | 50000 | 43.4 | 16.3 | 73.3 | 5.8 |

Note that while the mechanical strength properties remain fairly constant, elevating the alloy content causes some decrease in conductivity. Larger particle size improves conductivity without sacrificing strength.

EXAMPLE XXI

The procedure of Example IV is followed substituting powdered molybdenum for the Invar. Good conductivity is obtained, but the product is harder, dimensionally stable, and wear resistant.

EXAMPLE XXII

The procedure of Example IV is followed substituting powdered tungsten for the Invar. Good conductivity is obtained, but the product is harder, dimensionally stable, and highly wear resistant.

EXAMPLE XXIII

The procedure of Example IV is followed substituting powdered Kovar (analysis above) for the Invar. Good conductivity is obtained, but the product is harder and dimensionally stable.

Dispersion strengthened metal, e.g., copper, aluminum or silver based composites combine the high electrical and thermal conductivities of the dispersion strengthened metal with other useful characteristics of one or more additive constituents. Following are some examples:

(1) Controlled Thermal Expansion Composites:

Dispersion strengthened metal, e.g., copper, aluminum or silver plus low expansion constituents such as Ni-Fe alloys, Kovar (Fe-28% Ni-18% Co), molybdenum, etc.

Here the objective is to make a composite with a coefficient of expansion that matches a glass or a ceramic with which it is sealed.

End Uses:

(a) Glass to metal seals-incandescent lamp leads, hermetically sealed connectors, (b) Intergrated circuit lead frames, Kovar replaces some of the Ni in Ni-Fe alloys with cobalt. This reduces nickel and reduces the diffusion into GlidCop. Cobalt has a lower solid solubility in copper with a similar diffusion coefficient as nickel. The loss in conductivity is less than with Ni-Fe alloys. Additionally, the thermal expansion coefficient of Kovar over the range of 20° C.–415° C. (Setting point for soda lime glass) is lower than that of Ni-Fe alloys. Kovar has a thermal coefficient of expansion similar to tungsten in this temperature range but bonding is expected to be easier. Low in conductivity will be greater than with tungsten.

(2) High Strength Composite:

Dispersion strengthened metal, e.g., copper, aluminum or silver plus high strength constituents such as high strength steels (maraging steels, stainless steels, music wire, etc.), molybdenum, etc.

Here the objective is to make a composite with strength comparable to Cu-Be alloys with spring properties equivalent or superior to the latter. Electrical conductivity higher than Cu-Be alloys is also desirable.

End Uses:

(a) Electrical and electronic connectors, (b) Current carrying springs, (c) Switch components, (d) High strength sleeve bearings, (e) Circuit breakers.

(3) Wear Resistant Composite:

Dispersion strengthened metal, e.g., copper, aluminum or silver plus tungsten, molybdenum, titanium carbide titanium.

Here the objective is to make a composite with high hardness and wear resistance.

End Uses:

(a) Electrical contacts, (b) Resistance welding electrodes, (c) MIG welding tips, (d) Hazelett caster side dam blocks, (e) Die casting plunger tips, (f) Plastic injection molding tools, (g) Commutators, (h) Continuous or DC casting molds.

(4) Magnetic Composite:

Dispersion strengthened metal, e.g., copper, aluminum or silver, plus a magnetic component such as steel, Fe, Ni, Co alloys.

Here the objective is to make a composite having high conductivity with superior high temperature softening resistance and also having magnetic characteristics which enable handling of components on automated equipment.

End Uses:

(a) Discrete component or axial (diode) leads, (b) Rotors for X-ray tube anodes.

What is claimed is:

1. A substantially fully dense compacted and unsintered powdered metal composite comprising (a) a metal or metal alloy matrix having uniformly dispersed therein discrete microparticles of a refractory metal oxide and (b) discrete macroparticles of a metal, metal alloy or metal compound selected from the group consisting of the metals molybdenum, titanium, and niobium, the metal alloys of nickel with iron, nickel with iron and cobalt, cobalt with iron, nickel with chromium, nickel with molybdenum, chromium with molybdenum, and the metal compound titanium carbide, said components (a) and (b) being no more than minimally alloyed together.

2. A substantially fully dense composite as defined in claim 1 wherein the refractory metal oxide is aluminum oxide.

3. A substantially fully dense composite as defined in claim 2 wherein the concentration of aluminum in the matrix is in the weight range of from 0.01% to about 5%.

4. A substantially fully dense composite as defined in claim 1 wherein componenent (a) is a dispersion strengthened metal having an electrical resistivity below $8\times10^{-6}$ ohm-cm.

5. A substantially fully dense composite as defined in claim 1 wherein component (a) is dispersion strengthened copper.

6. A substantially fully dense composite as defined in claim 1 wherein component (a) is a dispersion strengthened copper, and said composite has a coefficient of thermal expansion below $13\times10^{-6}$/°C. at 20° C.

7. A substantially fully dense composite as defined in claim 1 wherein component (a) is dispersion strengthened copper alloy.

8. A substantially fully dense unsintered powdered metal composite comprising (a) a metal alloy matrix having uniformly dispersed therein discrete microparticles of a metal oxide and (b) discrete macroparticles of an additive metal or its alloys or its compounds.

9. A substantially fully dense composite as defined in claim 8 wherein said additive metal or its alloy is molybdenum,—or—niobium.

10. A substantially fully dense compacted and unsintered powdered metal composite comprising (a) a copper-tin alloy matrix having uniformly dispersed therein discrete microparticles of a refractory metal oxide and (b) discrete macroparticles of a metal, metal alloy or metal compound selected from the group consisting of the metals molybdenum, tungsten, titanium, and niobium, the metal alloys of nickel with iron, nickel with cobalt and iron, cobalt with iron, nickel with chromium, nickel with molybdenum, chromium with molybdenum, and the metal compounds tungsten carbide and titanium carbide, said components (a) and (b) being no more than minimally alloyed together.

11. A substantially fully dense composite as defined in claim 10 wherein the metal alloy of nickel and iron contains from 30% to 55% nickel by weight.

12. A substantially fully dense composite as defined in claim 11 wherein the metal alloy of nickel and iron contains about 42% by weight nickel.

13. A substantially fully dense compacted and unsintered powdered metal composite comprising (a) a metal or metal alloy matrix having uniformly dispersed therein discrete microparticles of a refractory metal oxide and (b) discrete macroparticles of metal, metal alloy or metal compound selected from the group consisting of the metals molybdenum, tungsten, titanium, and niobium, the metal alloys of nickel with iron, nickel with iron and cobalt, cobalt with iron, nickel with chromium, nickel with molybdenum, chromium with molybdenum, and the metal compounds tungsten carbide and titanium carbide, said components (a) and (b) being no more than minimally alloyed together wherein the composite is contained within at least one metallic sheath.

14. A substantially fully dense composite as defined in claim 13 wherein the metallic sheath is nickel.

15. A substantially fully dense composite as defined in claim 13 wherein the metallic sheath is copper.

16. A substantially fully dense compacted and unsintered powdered metal composite comprising (a) a metal or metal alloy matrix having uniformly dispersed therein discrete microparticles of a metal oxide and (b) discrete macroparticles of an additive metal, or its alloys, or its intermetallic compounds, and wherein the composite is contained within at least one metallic sheath.

17. A substantially fully dense composite as defined in claim 16 wherein the metallic sheath is nickel.

18. A substantially fully dense composite as defined in claim 16 wherein the metallic sheath is copper.

19. A substantially fully dense compacted and unsintered powdered metal composite comprising (a) dispersion strengthened copper having uniformly dispersed therein discrete microparticles of aluminum oxide and (b) discrete macroparticles of a metal alloy of nickel with iron, said components (a) and (b) being no more than minimally alloyed together.

* * * * *